United States Patent [19]

Dingler et al.

[11] 4,243,431

[45] Jan. 6, 1981

[54] DISHWASHER SOIL SEPARATOR

[75] Inventors: Geoffrey L. Dingler, St. Joseph Township, Berrien County, Mich.; Philip P. Johnson, Conway, Ark.

[73] Assignee: Whirlpool Corporation, Benton Harbor, Mich.

[21] Appl. No.: 48,443

[22] Filed: Jun. 14, 1979

[51] Int. Cl.[3] ..... B08B 3/02

[52] U.S. Cl. ..... 134/104; 134/109; 134/186; 210/532.1

[58] Field of Search ..... 134/104, 109, 111, 176, 134/186; 210/532 R

[56] References Cited

U.S. PATENT DOCUMENTS

| | | | |
|---|---|---|---|
| 2,155,868 | 4/1939 | Pauly et al. | 134/186 X |
| 2,700,978 | 2/1955 | Pietsch | 134/186 |
| 3,457,929 | 7/1969 | Madden | 134/95 |
| 4,150,680 | 4/1979 | Johnson et al. | 134/104 |
| 4,168,715 | 9/1979 | Spiegel et al. | 134/104 |

FOREIGN PATENT DOCUMENTS

| | | | |
|---|---|---|---|
| 2639279 | 3/1978 | Fed. Rep. of Germany | 134/104 |
| 2639318 | 3/1978 | Fed. Rep. of Germany | 134/104 |

*Primary Examiner*—Robert L. Bleutge

*Attorney, Agent, or Firm*—Wegner, Stellman, McCord, Wiles & Wood

[57] ABSTRACT

A dishwasher apparatus having an improved soil separator arranged to bypass a portion of the dishwashing liquid being circulated by the circulation impeller and to separate from the bypass portion of the dishwashing liquid soil which may have been entrained therein. The cleansed dishwashing liquid is then returned to the circulation system for reuse in effecting the dishwashing operation. The soil separator is further arranged to separate from the dishwashing liquid delivered thereto air which may have been entrained in the liquid and return the air to the dishwashing liquid being circulated for washing the dishes. The structure for collecting the soil is arranged to collect the soil from a relatively slowly moving portion of the bypassed liquid. The soil separator structure is arranged to effectively discharge the collected soil to drain upon initiation of a drain operation. The drain port is disposed downstream of the collecting space and the separator structure is arranged to cause flow of dishwashing liquid past the collecting space and concurrently reversely from the outlet of the separator structure so as to provide a turbulent delivery of the collected soil to the drain port. The drain port is arranged to be maintained free of collected soil during the normal operation of the dishwasher and may be disposed adjacent the return outlet of the separator structure. The cross section of the liquid bypass passage may gradually increase from the inlet to the outlet thereof to facilitate separation of the soil from the dishwashing liquid. The drain port is located in an area of relatively rapid movement of the dishwashing liquid to provide improved cleansing of the drain port in the draining operation.

17 Claims, 7 Drawing Figures

DISHWASHER SOIL SEPARATOR

BACKGROUND OF THE INVENTION

1. Field of the Invention

This invention relates to apparatus for removing foreign matter from a flowing liquid and more specifically to means for removing soil and the like from dishwashing liquid in a dishwasher apparatus.

2. Description of the Prior Art

A number of different devices have been developed for removing soil and the like from dishwashing liquid in a dishwashing apparatus. One such structure is disclosed in U.S. Letters Pat. No. 3,457,929 of Richard E. Madden. As shown therein, the dishwashing liquid is returned from the tub into a funnel-like member having a perforated upper portion. The dishwashing liquid flows outwardly through the perforations into a collecting sump for recirculation to the tub by a recirculation pump. Foreign matter in the dishwashing liquid is caught to be retained within the perforated funnel portion. Upon completion of the dishwashing operation, the drain pump connected to the lower end of the funnel is actuated so as to draw the dishwashing liquid downwardly from the funnel to carry therewith the collected soil and foreign material for disposition to drain as desired.

An early dishwasher structure is shown in U.S. Pat. No. 1,034,229 of J. E. Gribben. The bottom of the tub is provided with a channel into which dirty water and sediment may flow in the operation of the dishwasher. This waste material is drawn off periodically through a front discharge element. A plate overlies the channel to prevent washing of the sediment from the channel in the operation of the dishwasher.

Jakob Buchi shows in U.S. Pat. No. 1,431,367 a device for separating sand carried in watercourses which includes means for checking the velocity of the incoming water so as to uniformly distribute the velocity across the width of a chamber permitting settling of sand from the water in the chamber. The device includes means for drawing off the upper clean layers of the water from which the sand has been settled.

In U.S. Pat. No. 1,853,589, W. R. Walker shows a dishwashing machine having a sump portion in which the soil accumulates during the dishwashing operation. A valve controls the discharge of the dishwashing liquid from the bottom of the sump as upon completion of the dishwashing operation so as to remove the collected soil from the bottom of the sump at that time.

Remigius Pauly et al. show in U.S. Pat. No. 2,155,868 a dishwashing machine similar to the Walker machine in providing a sump wherein the soil is collected during operation of the dishwasher and from which the soil may be removed with the dishwashing liquid upon completion of the dishwashing operation.

Edward W. N. Boosey shows in U.S. Pat. No. 2,237,545 a floor drain provided with a removable basket through which drain liquid may pass. A water and oil separator is provided in the sump for further cleaning of the drained liquid.

In U.S. Pat. No. 2,575,768, Harold C. Pearsall shows a skimmer device for skimming grease and the like from a liquid such as soup or other liquid foods. The grease is collected in the device and delivered therefrom by inversion of the device.

Joseph A. Pietsch shows a dishwasher with a soil separation chamber in U.S. Pat. No. 2,700,978 having an annular sump in which soil is collected during the dishwashing operation. A drain port communicates with the sump which is opened upon completion of the washing operation to drain liquid from the tub. The drain port is at the bottom of the soil collecting space.

William R. Molnar shows a clothes washing machine in U.S. Pat. No. 2,807,949 wherein an area of low turbulence is provided under the agitator. A nozzle is provided for discharging liquid and soil particles from the area of limited turbulence during the washing operation.

In U.S. Pat. No. 3,511,415, William P. Crowe shows a water cooler having a sloping upper wall and vents connecting the upper ends of a plurality of passes to the uppermost portion of the wall at the outlet of the cooler.

John B. Anderson et al show a method and apparatus for separating suspended material from a fluid stream in U.S. Pat. No. 3,768,648. The settling means includes a plurality of inclined passages of chevron cross section to provide a high critical flow rate. Material settled out from the liquid during the liquid flow through the apparatus collects in a V-shaped groove portion thereof from which the collected material is subsequently discharged.

SUMMARY OF THE INVENTION

The present invention comprehends an improved means for removing soil and foreign material from a liquid such as dishwashing liquid in an apparatus such as a dishwasher.

The soil separating means is further arranged to remove from the dishwashing liquid air which may be entrapped therein so as to maintain optimum efficiency in the operation of the apparatus.

The apparatus is arranged to maintain the drain port relatively clean during the operation of the dishwasher and to cause the collected soil to be delivered to the drain port by a turbulent liquid flow so as to prevent clogging of the drain port during the draining operation.

The invention comprehends locating the drain port in spaced relationship to the soil collecting space. In the illustrated embodiment the drain port is disposed adjacent the outlet from the accumulator defining a bypass passage connected in parallel with the main flow passage of the recirculation system of the dishwasher.

The soil separator of the liquid flow apparatus of the present invention is extremely simple and economical of construction while yet providing an improved soil separation function as discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
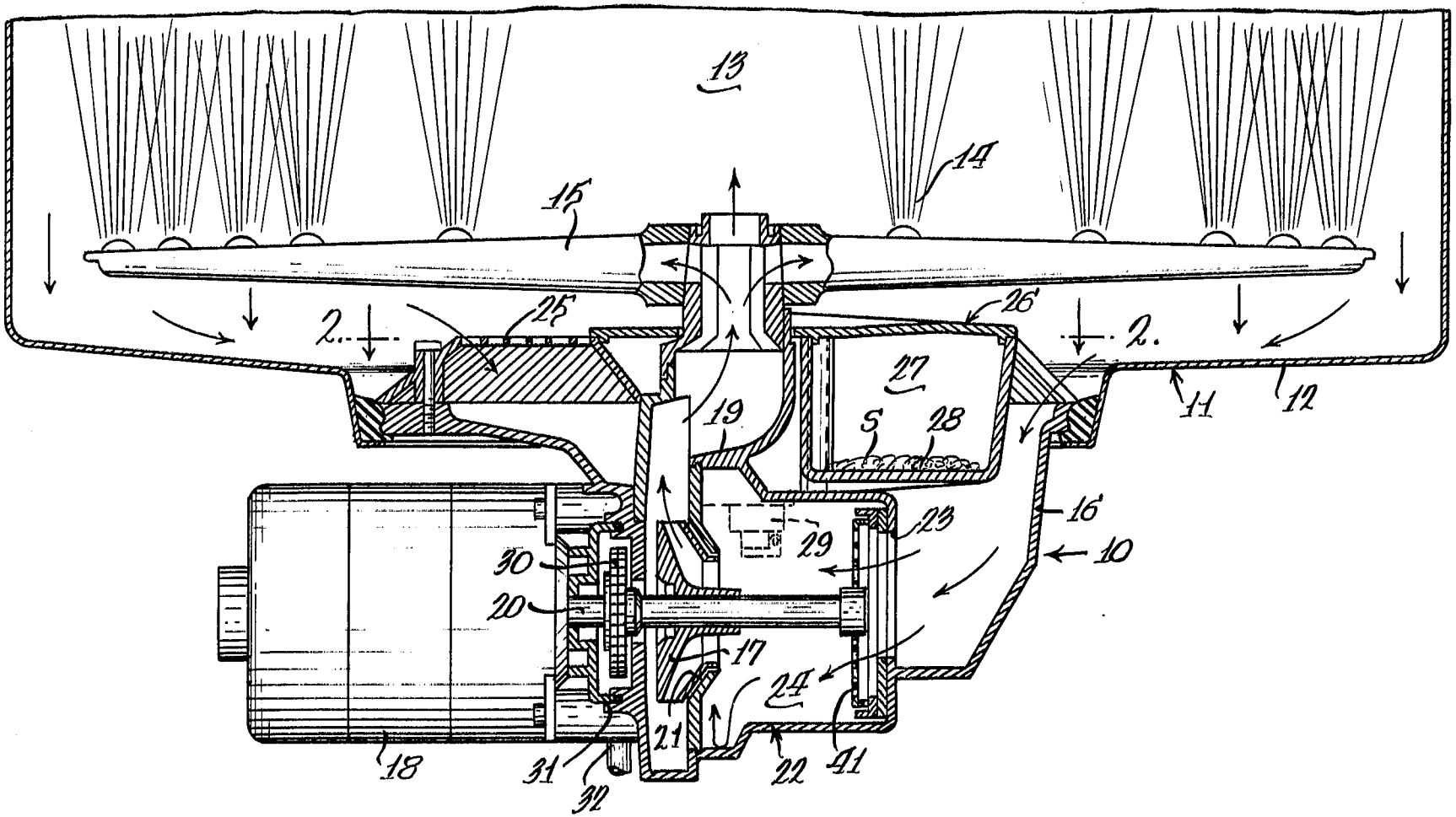
FIG. 1 is a fragmentary vertical section of a dishwasher apparatus having a soil separation means embodying the invention.

In the exemplary embodiment of the invention as disclosed in the drawing, a liquid flow apparatus generally designated 10 is shown to comprise a portion of a dishwasher 11. The dishwasher may include a tub 12 defining a dishwashing chamber 13 in which dishes and the like are washed by impingement thereagainst of suitable dishwashing liquid which may be delivered thereto in the form of spray jets 14 provided from a spray arm 15.

The bottom wall of the tub 12 defines a sump portion 16 for collecting the dishwashing liquid falling downwardly thereto in the spraying operation. As shown in FIG. 1, the liquid flow apparatus 10 may include a circulation impeller 17 driven by a suitable electric motor 18. Impeller 17 delivers the dishwashing liquid through a suitable conduit structure 19 to the spray arm 15 for recirculated use of the dishwashing liquid in effecting the dishwashing operation.

As further seen in FIG. 1, impeller 17 is carried on the drive shaft 20 of the motor 18 outwardly of a discharge portion 21 of a separator generally designated 22 having an intake portion 23 communicating with the sump 16. Thus, the dishwashing liquid flows from sump 16 through intake portion 23, through a flow passage 24 defined by the separator 22, and outwardly therefrom through the discharge portion 21 to the spray arm 15. Thus, flow passage 24 defines a main flow passage in the recirculated flow of the dishwashing liquid in the normal operation of the dishwasher.

A screen 25 may be provided across the top of sump portion 16 for preventing passage of large objects, such as silverware and the like, downwardly into the sump. As indicated above, however, it is further desirable to remove soil and other small particles from the dishwashing liquid which may pass through the screen 25 so as to maintain the recirculated dishwashing liquid relatively clean for improved dishwashing operation. As indicated, the invention comprehends the provision of means for continuously cleansing the dishwashing liquid during the dishwashing operation and automatically discharging the removed soil and foreign matter to drain upon completion of the dishwashing operation.

More specifically, the means for removing soil and foreign matter from the dishwashing liquid includes an accumulator generally designated 26 which defines a bypass flow passage 27 through which a portion of the circulated dishwashing liquid is flowed during the washing operation. The accumulator is arranged so as to extract from the flowing bypassed liquid, soil and foreign matter and to collect the same at a collection space generally designated 28 as shown in FIG. 1.

Upon completion of the dishwashing operation, the collected soil S is flushed from the collection space 28. The flushing operation is controlled by a solenoid valve 29 and a drain impeller 30 which is also carried on motor shaft 20 and disposed within a drain housing portion 31 of the apparatus. The drain dishwashing liquid may be discharged through a suitable drain conduit 32 as desired.

Figure 2:
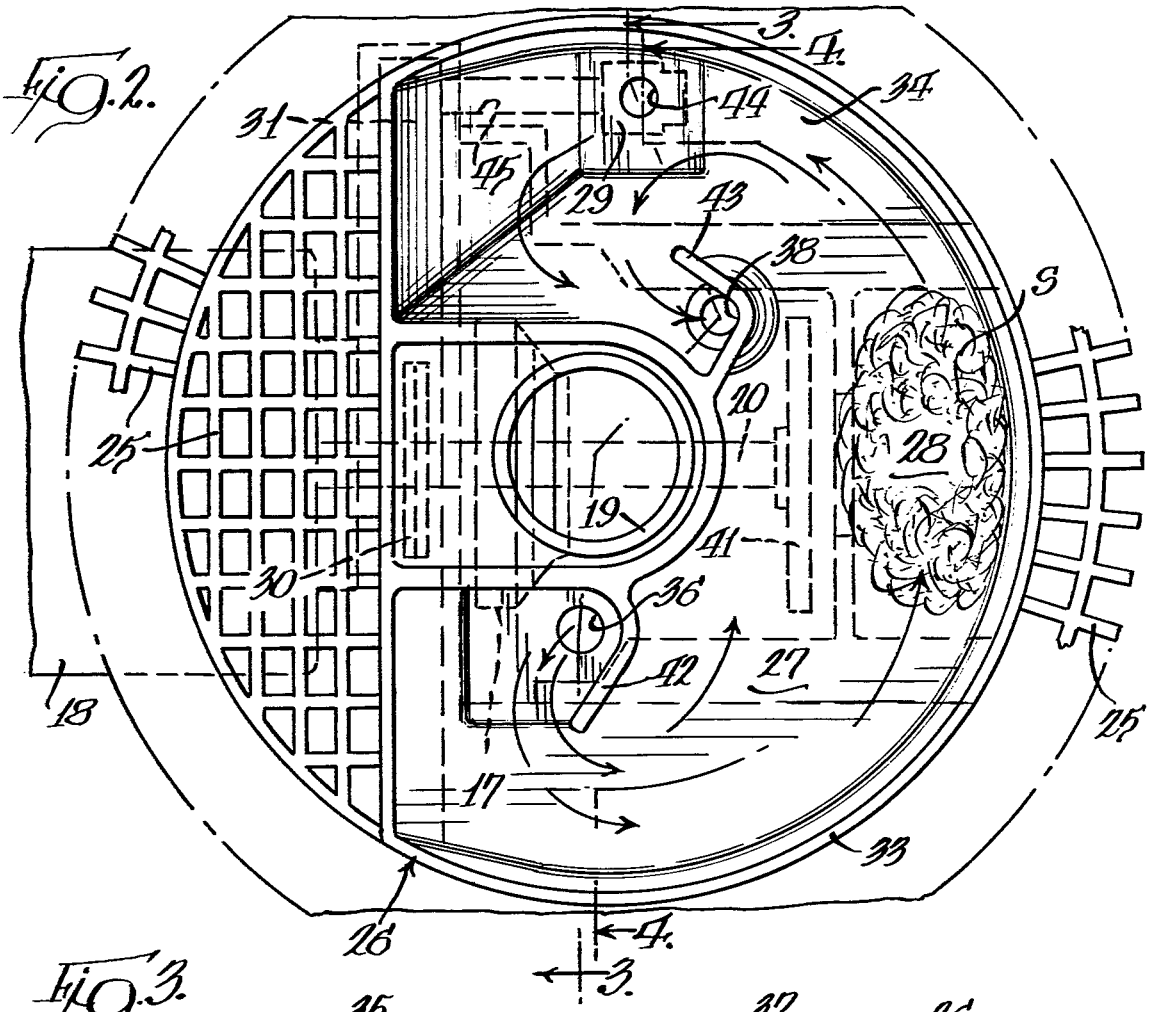
FIG. 2 is a fragmentary enlarged horizontal section taken substantially along the line 2—2 of FIG. 1.
Figure 3:
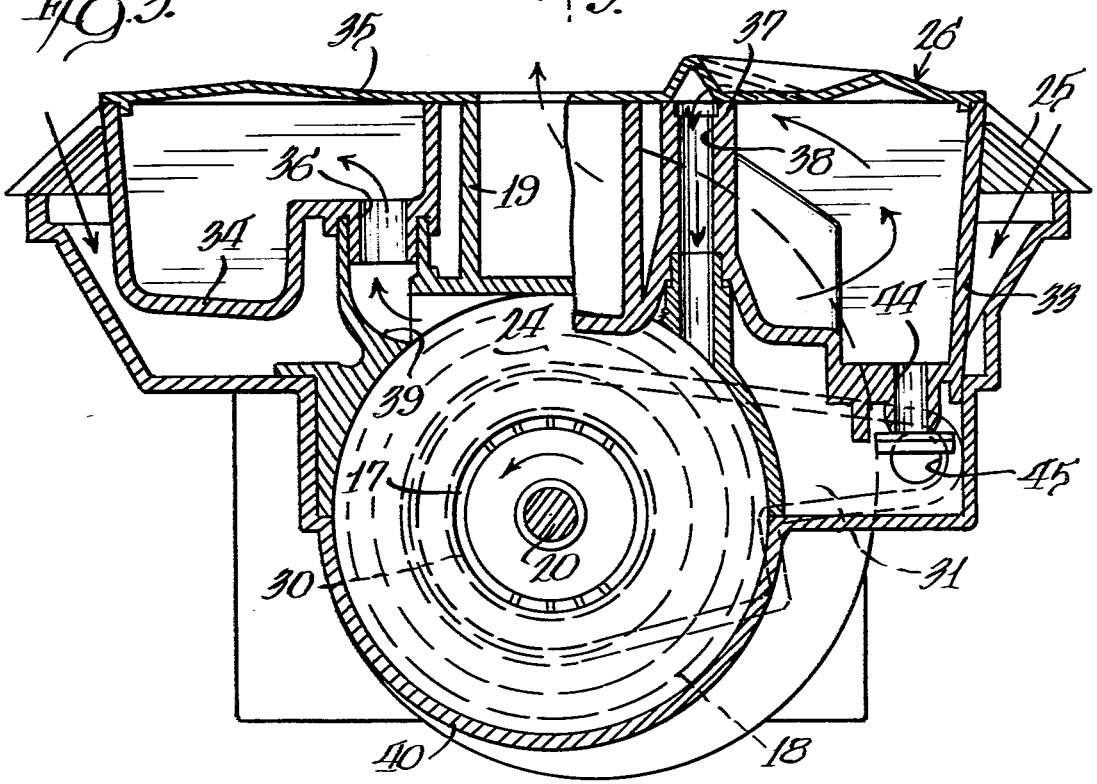
FIG. 3 is a fragmentary vertical section taken substantially along the line 3—3 of FIG. 2.

As best seen in FIGS. 2 and 3, accumulator 26 is defined by a generally U-shaped housing 33 extending about conduit structure 19. The housing is defined by a sloping bottom wall 34 and a sloping top wall 35. Bottom wall 34 is provided with an inlet opening 36 communicating with separator flow passage 24. Bottom wall 34 further defines an upstanding tubular portion 37 defining an upper outlet opening 38 which communicates with the flow passage 24 through the tubular portion 37 as best seen in FIG. 3. As shown therein the inlet opening 36 includes an elbow portion 39 which opens generally tangentially to a cylindrical outer wall 40 of the separator 22. Tubular portion 37 opens to the flow passage 24 at a substantial angle to the tangential direction. Thus, liquid moving in a counterclockwise direction as seen in FIG. 3 tends to create a high pressure at elbow 39 and a lower pressure at tubular portion 37 such that the pressure differential moves the liquid into elbow 39 and inlet 36 and to draw liquid downwardly through tubular portion 37 back into the flow passage 24. Such a counterclockwise swirling movement of the liquid is effected in flow passage 24 by a separator impeller 41 (FIG. 1) also carried on motor shaft 20 and disposed inwardly adjacent the intake portion 23 of the separator housing.

Thus, as seen in FIG. 2, a portion of the dishwashing liquid flowing through separator flow passage 24 is bypassed therefrom to the accumulator 26 by the combined action of the inlet 36 and outlet 38 arrangements. As seen in FIG. 2, the bypass liquid enters the accumulator behind a baffle 42 thereof and flows through the bypass passage 27 defined by the accumulator past the collection space 28 and around a second baffle 43 to the outlet opening 38.

Adjacent the outlet opening 38 and spaced from the collection space 28, the bottom wall 34 of the accumulator is provided with a drain opening or port 44. The drain opening is selectively closed by the valve 29 which, as shown in FIG. 2, communicates with the drain portion 31 of the apparatus through transfer conduit 45. As seen in FIG. 2, the drain opening 44 is spaced substantially from collection space 28 so as to effectively avoid collection of the soil S on the drain opening during the normal operation of the dishwasher.

The cross section of flow passage 27 widens to collection space 28 from the inlet opening 36. However, as seen in FIG. 2, baffle 43 cooperates with the outer wall of the housing 33 to restrict the liquid flow so that a relatively higher velocity occurs adjacent the drain opening 44 so as to effectively maintain the drain opening 44 flushed free of collected soil and foreign matter during the dishwashing operation. Also, baffle 38 causes the flow of dishwashing liquid through the bypass passage 27 to abruptly change in direction adjacent the drain port 44 so as to provide a turbulence thereat during the normal operation of the dishwasher which effectively maintains the drain opening 44 clear of collected soil and foreign material which may be carried past the collection space 28.

As seen in FIG. 3, the outlet opening 38 is at an elevation substantially higher than the elevation of the inlet opening 36. Thus, the flow of dishwashing liquid through the bypass passage 27 is from a lower portion to a higher portion thereof so as to cause the liquid moving along the bottom wall 34 to have a relatively lower speed than the portion moving upwardly to adjacent the top wall 35. Thus, settling out and depositing of the soil S in the collection space is facilitated to further ensure maximum efficiency in the cleansing of the dishwashing liquid by the separator and accumulator structures.

As seen in FIG. 3, bottom wall 34 slopes downwardly from adjacent inlet opening 36. Thus the cross-sectional area of flow passage 27 increases to the collecting space 28 as discussed above so as to provide maximum efficiency in the settling out of the soil material S.

Figure 4:
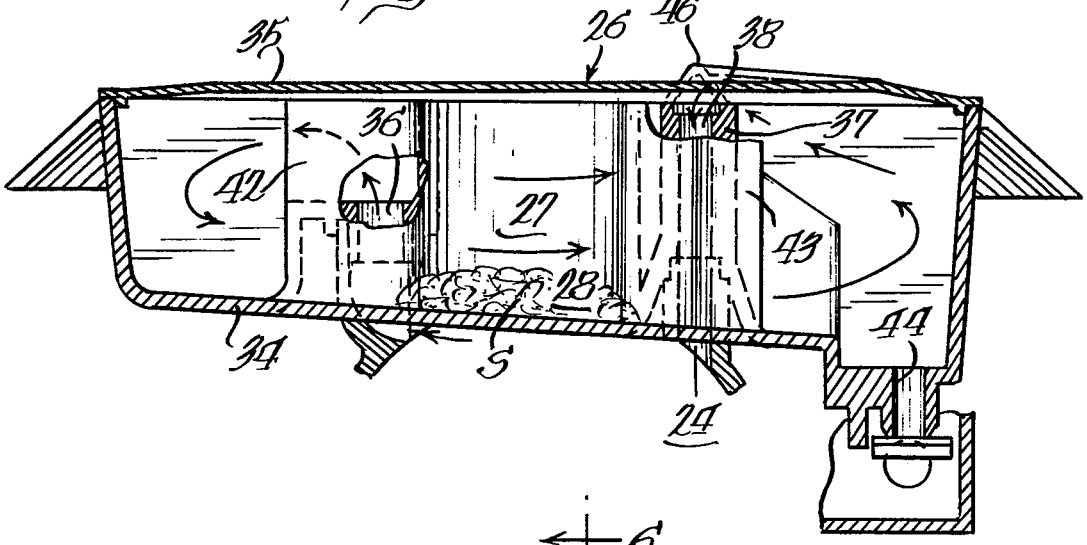
FIG. 4 is a fragmentary vertical section taken substantially along the line 4—4 of FIG. 2.

Referring to FIG. 4, the operation of the soil separating means in the accumulator 26 is graphically illustrated. As shown, the dishwashing liquid flows from the inlet 36 through the bypass passage 27 where the soil collects in collection space 28 and then the cleansed liquid flows to the elevated outlet opening 38 and thence downwardly through the tubular portion 37 back to the separator flow passage 24.

As seen in FIG. 4, top wall 35 of the accumulator slopes upwardly to a top portion 46 overlying the outlet port 38. Thus, air entrapped in the dishwashing liquid which may pass outwardly from passsage 24 during the flow of dishwashing liquid through the bypass passage 27 passes along the underside of top wall 35 to the top portion 46. By virtue of the close relationship of top portion 46 to the outlet opening 38, the air is directed back into the outflowing dishwashing liquid so as to be removed from the accumulator and delivered to the liquid being pumped by the circulation pump 31 to the spray arms 15. Thus, the apparatus is arranged to ensure that a maximum volume of bypassed liquid is maintained within the accumulator and to assure that the dishwashing liquid may wash against the undersurface of the top wall 35 to prevent accumulation of soil thereon.

Figure 5:
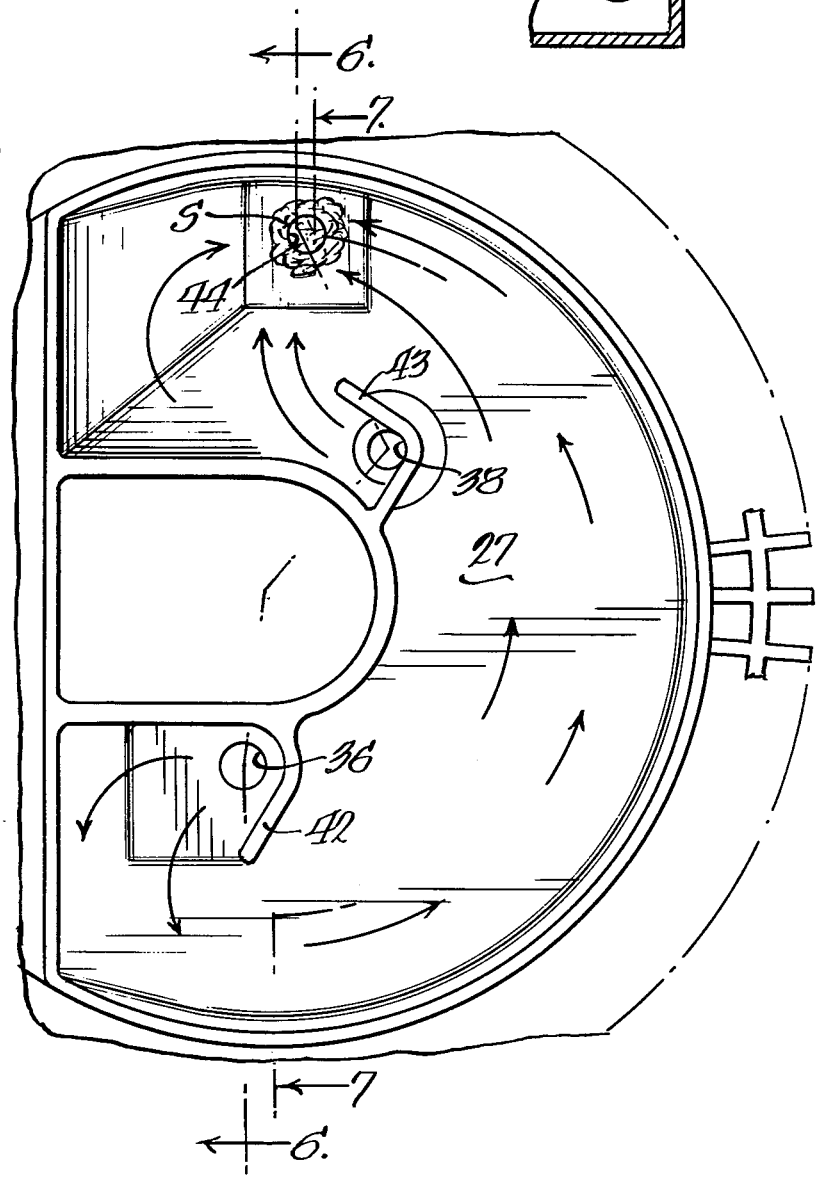
FIG. 5 is a fragmentary horizontal section illustrating the flow conditions obtaining during the drawing operation.
Figure 6:
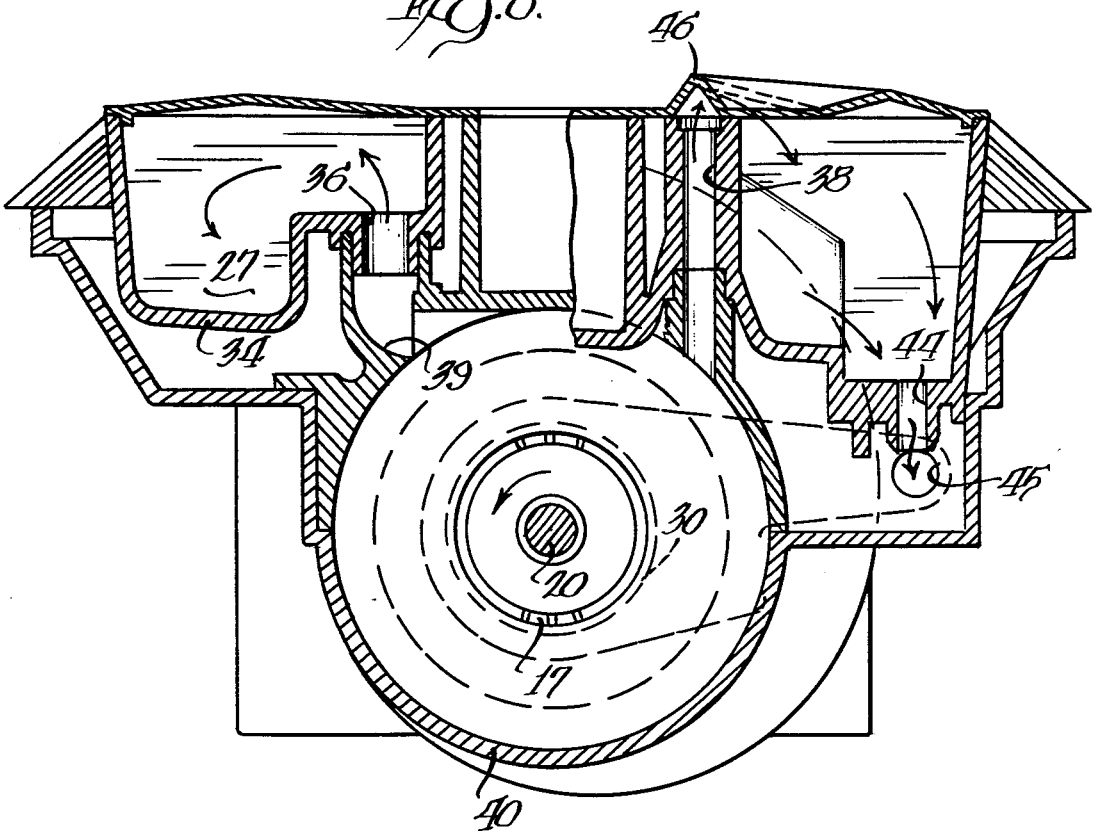
FIG. 6 is a fragmentary vertical section taken substantially along the line 6—6 of FIG. 5.
Figure 7:
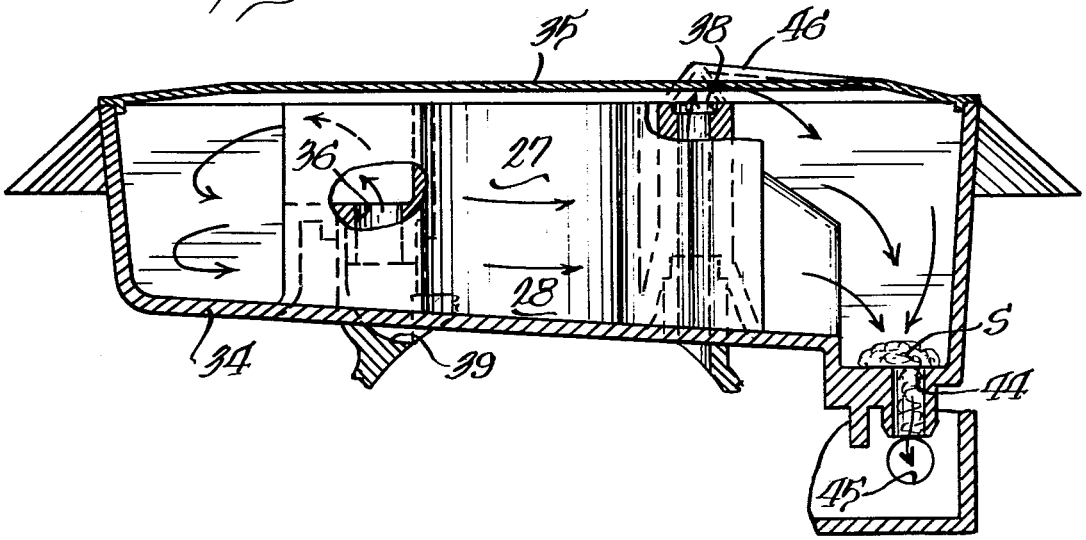
FIG. 7 is a fragmentary vertical section taken substantially along the line 7—7 of FIG. 5.

Referring now to FIGS. 5–7, the functioning of the accumulator during the drain operation may be seen. In effecting the drain operation, solenoid valve 29 is actuated to open the drain 44. This allows the drain impeller 30 to draw dishwashing liquid through transfer conduit 45 from the drain port 38. This action further causes the dishwashing liquid in flow passage 27 to be drawn not only from the inlet port 36 but also from the outlet port 38 to the drain port 44 as shown by the arrows in FIG. 5 because drain port 44 is at a lower pressure than either inlet 36 or outlet 38. This forcible suction of the dishwashing liquid from the bypass passage 27 turbulently carries the collected soil S from the collecting space 28 to the drain port 44 for delivery of the draining liquid to the discharge conduit 32 for suitable disposal.

It should be noted that the drain opening 44 is at the bottom of the accumulator so that the flow of liquid during the drain operation is directed along the bottom wall 34 so as to most effectively remove the collected soil S from the collection space 28 and deliver it to the drain opening. Further, by locating the drain port 44 adjacent the outlet port 38 a high turbulence in the flow of the draining liquid is obtained for facilitating the removal of the collected soil S. This tends to break up any slugs of soil material and to dilute any heavy concentration of the soil in the dishwashing liquid.

The improved arrangement of accumulator 26 effectively assures the prevention of blockage of the drain opening 44 as may occur where collected soil is permitted to accumulate on or in the drain opening. Thus the present invention comprehends an improved soil separating structure which is effectively maintenance free while yet providing high efficiency in the soil removal operation.

The foregoing disclosure of specific embodiments is illustrative of the broad inventive concepts comprehended by the invention.

The embodiments of the invention in which an exclusive property or privilege is claimed are defined as follows:

1. In a dishwasher apparatus having a dishwashing liquid circulating means defining a flow passage having an intake portion and a discharge portion, pump means for causing dishwashing liquid flow through said flow passage from said intake portion to said discharge portion, means defining a bypass passage having an inlet and an outlet each communicating with said flow passage downstream of said intake portion to bypass a portion of the liquid through said bypass passage as an incident of flow of the liquid through said flow passage, the improvement comprising:

collecting means in said bypass passage means for collecting soil from the liquid flowed through said bypass passage and depositing the collected soil at a collecting position within said bypass passage intermediate said inlet and said outlet;

means defining a drain port communicating with said bypass passage spaced from said collecting position to be free of collected soil during bypass flow of the liquid through said bypass passage from said inlet to said outlet;

means for selectively closing said drain port to permit said liquid flow through said bypass passage past said closed drain port for collecting said soil at said collecting position; and means for concurrently opening said drain port and causing liquid flow from said flow passage inwardly through each of said inlet and outlet into said bypass passage for flow therethrough to transfer the collected soil from said collecting position to said drain port for facilitated elimination of the soil through the drain port.

2. The dishwasher apparatus of claim 1 wherein said drain port is disposed intermediate said collecting position and said outlet.

3. The dishwasher apparatus of claim 1 further including means for delivering entrapped air from within said bypass passage to said outlet as an incident of flow of the liquid through the bypass passage to the outlet.

4. The dishwasher apparatus of claim 1 wherein said bypass passage means defines an air collecting space adjacent said outlet for delivering entrapped air from within said bypass passage into liquid being returned from said bypass passage to said flow passage.

5. The dishwasher apparatus of claim 1 wherein said bypass passage includes a sloped top wall defining at an upper portion thereof adjacent said outlet an air collecting space for delivering entrapped air from within said bypass passage into liquid being returned from said bypass passage to said flow passage.

6. The dishwasher apparatus of claim 1 wherein said drain port is disposed in a restricted portion of the bypass passage to be swept by liquid flowing at relatively high speed to said outlet after the liquid passes through said collecting position at a lower speed whereby the drain port is effectively maintained free of collected soil during normal flow of the liquid through the bypass passage from the inlet to the outlet.

7. The dishwasher apparatus of claim 1 wherein said bypass passage means defines a bypass passage which increases in cross-sectional area from said inlet to said collecting space to facilitate separation of the soil from the liquid at said collection space.

8. The dishwasher apparatus of claim 1 wherein said bypass passage means defines a sloping bottom wall providing an increase in the cross-sectional area of the bypass passage from said inlet to said collecting space to facilitate separation of the soil from the liquid at said collection space.

9. The dishwasher apparatus of claim 1 wherein said bypass passage includes a restricted portion adjacent said outlet for providing relatively high rate of flow of the liquid therethrough, said drain port communicating with said restricted portion of the bypass passage.

10. The dishwasher apparatus of claim 1 wherein said outlet is disposed at an elevation above the elevation of the inlet whereby the liquid in the lower portion of the bypass passage flows at a minimum rate, said collecting space being located in the lower portion of the bypass passage for facilitated collection of the soil from relatively more slowly moving liquid.

11. The dishwasher apparatus of claim 1 wherein said last named means includes a drain impeller for drawing liquid through the drain port upon opening thereof.

12. The dishwasher apparatus of claim 1 wherein said drain port is disposed adjacent said outlet.

13. The dishwasher apparatus of claim 1 wherein said bypass passage means extends about said flow passage means.

14. In a dishwasher apparatus having a recirculating spray system including means defining a flow passage having an intake portion and a discharge portion, circulation impeller means for causing dishwashing liquid flow through said flow passage from said intake portion to said discharge portion, a soil separator defining a bypass passage having an inlet communicating with said flow passage and an outlet communicating with said flow passage downstream of said inlet to bypass a portion of the dishwashing liquid through said flow passage, the improvement comprising:

collecting means in said bypass passage means collecting soil from the dishwashing liquid flowed through said bypass passage and returning the collected soil at a collecting position within said bypass passage intermediate said inlet and said outlet;

means defining a drain port communicating with said bypass passage spaced from said collecting position, said drain port disposed to be swept by liquid flowing to said outlet to be free of collected soil during bypass flow of the liquid through said bypass passage from said inlet to said outlet;

valve means for selectively closing said drain port to permit said liquid flow through said bypass passage past said closed drain port for collecting said soil at said collecting position;

means for operating said valve means to open said drain port; and drain impeller means for causing dishwashing liquid flow from said flow passage concurrently inwardly through said inlet and outlet, through said bypass passage into said open drain port thereby to transfer the collected soil from said collecting position to said drain port for facilitated elimination of the soil through the drain port.

15. The dishwasher apparatus of claim 14 wherein said circulation impeller and drain impeller are concurrently driven.

16. The dishwasher apparatus of claim 14 wherein said discharge portion of the spray system comprises a spray arm and said intake portion comprises a portion of a tub sump.

17. The dishwasher apparatus of claim 1 or 14 further including means for removing entrapped air from the dishwashing liquid in said soil separator and returning it to the dishwashing liquid being delivered through said flow passage to the discharge portion.

* * * * *

UNITED STATES PATENT AND TRADEMARK OFFICE

CERTIFICATE OF CORRECTION

PATENT NO. : 4,243,431

DATED : January 6, 1981

INVENTOR(S) : Geoffrey L. Dingler and Philip P. Johnson

It is certified that error appears in the above-identified patent and that said Letters Patent are hereby corrected as shown below:

Claim 14, column 8, line 1, after "liquid" insert --through said bypass passage as an incident of flow of the dishwashing liquid--

Signed and Sealed this

*Twelfth* Day of *July 1983*

[SEAL]

*Attest:*

GERALD J. MOSSINGHOFF

*Attesting Officer*

*Commissioner of Patents and Trademarks*